United States Patent [19]

Drapkin

[11] Patent Number: 4,552,421

[45] Date of Patent: Nov. 12, 1985

[54] ELECTRIC OUTLET HAVING NOVEL SCREW ANCHOR AND GROUND CONNECTION

[75] Inventor: William B. Drapkin, Jamesville, N.Y.

[73] Assignee: Pass & Seymour, Inc., Solvay, N.Y.

[21] Appl. No.: 572,804

[22] Filed: Jan. 23, 1984

[51] Int. Cl.[4] ..... H01R 4/66

[52] U.S. Cl. ..... 339/14 R; 339/133 R

[58] Field of Search ..... 174/51, 53; 339/14 R, 339/14 L, 133, 122 R, 122 F, 123

[56] References Cited

U.S. PATENT DOCUMENTS

| | | | |
|---|---|---|---|
| 2,267,771 | 12/1941 | von Holtz | 339/133 R |
| 2,326,538 | 8/1943 | Hütt | 174/51 X |
| 2,857,452 | 10/1958 | Carlson | 339/133 X |
| 3,032,736 | 5/1962 | Howells | 339/14 R |

*Primary Examiner*—Eugene F. Desmond

*Attorney, Agent, or Firm*—Charles S. McGuire

[57] ABSTRACT

The metal yoke or mounting strap of an electric receptacle includes an integrally formed portion stamped from the central section and bent to extend toward the receptacle cover. The screw holding the wall plate in position extends through aligned openings in the plate and receptacle cover to contact the portion of the mounting strap, providing a ground path for the screw and the wall plate in units wherein the latter is also of metal. Several means of anchoring the screw are disclosed, including tapping of the receptacle cover opening and/or the mounting strap section, one or more stamped teeth on the integrally formed strap section, and the use of self-tapping screws. In any event, significant cost savings are realized by elimination of the useful, internally threaded rivet or eyelet positioned in the receptacle cover opening and extending to contact with the mounting strap.

2 Claims, 10 Drawing Figures

ELECTRIC OUTLET HAVING NOVEL SCREW ANCHOR AND GROUND CONNECTION

BACKGROUND OF THE INVENTION

The present invention relates to electric receptacles or wall outlet units, and more particularly to receptacle assemblies and the mounting straps thereof which are more economical in manufacture than prior art units.

Electrical power is commonly provided to appliances and other equipment by insertion of the blades of a plug into a receptacle which thereby places the equipment in electrical communication with the power distribution lines. Over the years, a more or less standard design has been adopted for the electrical receptacles or outlets, the most common commercial versions including a metal yoke or mounting strap and a plastic receptacle cover having the apertures for insertion of the plug blades. The mounting strap and receptacle cover are normally positioned in an outlet box, of plastic or metal, having an open side which the plug-receiving side or the receptacle cover faces.

It is also the usual practise to position a wall plate over the receptacle cover with the portions thereof surrounding the blade-receiving apertures exposed through openings in the plate. The open side of the outlet box is thus covered by the wall plate, both to protect the incoming electrical distribution lines and, in most cases, to enhance the appearance of the outlet by mounting essentially flush with the wall surface. The most common means of holding the face plate in position is a metal screw fastener extending through an opening in the plate into an internally threaded eyelet or rivet extending through an aligned opening in the plastic receptacle cover and in electrical contact with the grounded mounting strap. Since safety codes require that all exposed metal be grounded, the rivet provides both an anchor and a ground connection for the screw, as well as for the face plate in the event it is also of metal. Thus, although the threaded rivet effectively serves the intended purpose, it is a separately fabricated part and requires assembly with the other elements, thereby adding a significant increment to the total cost of the receptacle.

It is the principal object of the present invention to provide a more economical means of fabricating electric receptacles without sacrificing any features of operation or saftey of prior art units of the same type.

A further object is to provide a novel and economical means of providing a ground connection for a screw fastener used to secure the wall plate of an electric receptacle, as well as for the wall plate itself, where necessary.

Another object is to provide a mounting strap for an electric receptacle having a unique configuration facilitating electrical ground connection of a screw fastener holding the receptacle wall plate in position.

A still further object is to provide an electric receptacle having novel and improved means for anchoring the wall plate screw fastener.

Still another object is to provide an electrical receptacle with attached wall plate which eliminates one of the parts conventionally provided in prior art receptacles of the same type.

Other objects will in part be obvious and will in part appear hereinafter.

SUMMARY OF THE INVENTION

In furtherance of the foregoing objects, the invention contemplates an electric receptacle mounting strap of otherwise conventional design having a central section with an integrally formed, elongated portion extending toward the receptacle cover positioned for contact by, and thus establishing a ground path for, a screw fastener extending through aligned openings in the wall plate and receptacle cover. The integrally formed portion is provided by a stamping operation in which a three-sided cut is made in the central section of the metal body, which normally lies in a plane essentially perpendicular to the axis of the screw fastener, and the cut portion bent along the fourth side, where it remains attached to the strap central section, to extend toward the receptacle cover.

In the preferred embodiment, a cut-out area is provided in the integrally formed portion, as part of the same stamping operation, extending from the free end for a part of the length of the portion to define two spaced, opposing edges. The receptacle cover is provided with the usual, centrally disposed, circular opening, from each side of which an additional, slotted opening extends. When in the assembled condition, the free end of the integrally formed portion of the mounting strap extends into the slotted openings in the receptacle cover with a close clearance. The distance between the spaced edges of the cut-out area is substantially equal to the diameter of the circular portion of the receptacle cover opening. The opening and edges of the cut-out area are then simultaneously tapped to provide internal threads for engagement by the screw fastener which holds the wall plate over the receptacle cover, thereby both anchoring the screw and providing a ground contact by its contact with the mounting strap elongated portion.

In other embodiments the tapping step is eliminated and one or both of the opposing edges of the cut-out area are provided with one or more teeth, in the same sampling operation by which the elongated portion is formed, for engaging the screw fastener. In a further embodiment, the receptacle cover is of a thermoplastic material having a circular opening suitable for self-tapping by the screw fastener which is thereby anchored to the receptacle cover, the ground path being provided by positioning the elongated portion for contact by, but not threaded engagement with, the screw.

These and other features of construction and operation of the various embodiments of the invention will be more readily understood with reference to the accompanying drawings.

DETAILED DESCRIPTION

Figure 1:
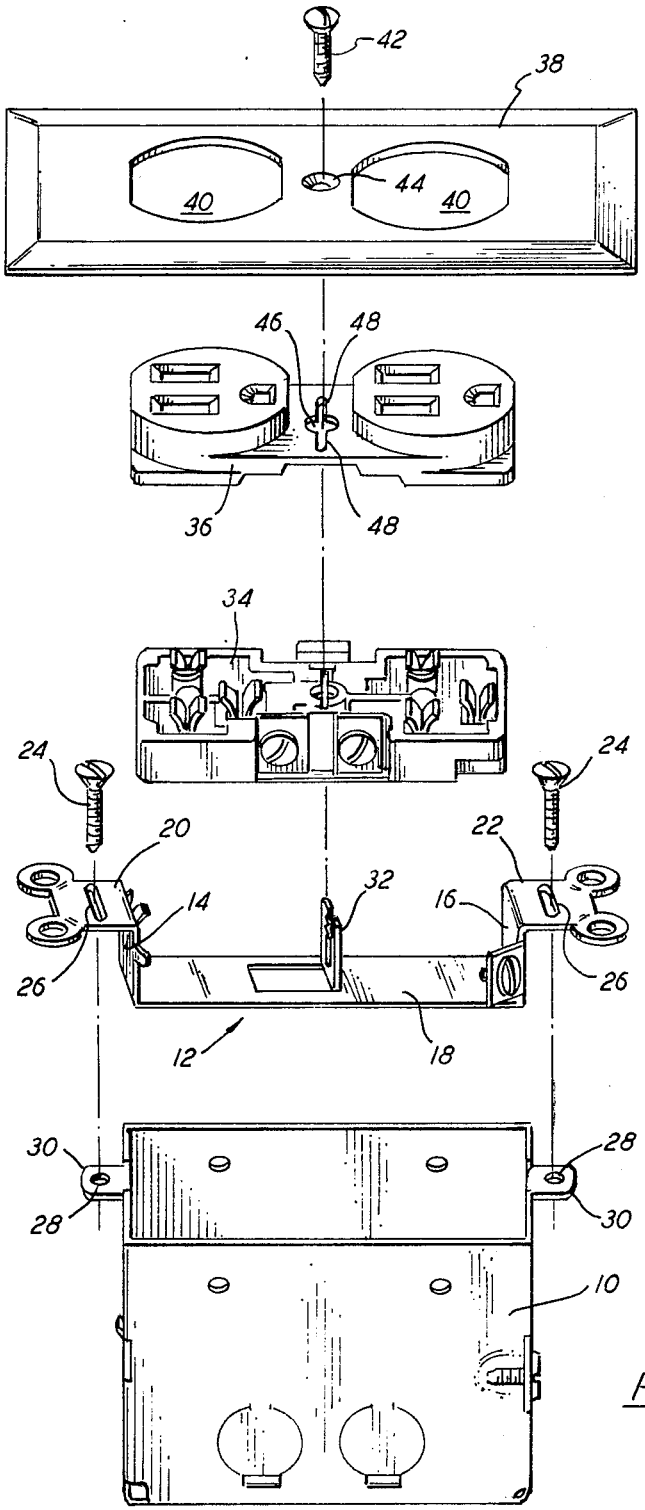
FIG. 1 is an exploded perspective view of an electric receptacle constructed according to the invention.

Referring now to the drawings, in FIG. 1 is shown a typical electrical outlet box 10, closed on five sides and open on the sixth to receive and house elements of the receptacle assembly. Yoke or mounting strap 2 is of the usual, U-shaped configuration, having parallel legs 14 and 16, joined by central portion 18 and having mounting tabs 20 and 22, respectively, extending outwardly therefrom. Mounting strap 12 is secured to outlet box 10 by screws 24 which extend through slots 26 into threaded openings 28 in ears 30 on box 10, providing automatic ground to metallic boxes without jumpers or box clips.

The portions of mounting strap 10 just described are conventional in elements of this nature which have been in use for many years. In addition, mounting strap 12 of the present invention includes what will be termed an elongated portion, denoted by reference numeral 32 and formed integrally with central portion 18 by a stamping operation. In the illustrated configurations, portion 32 is essentially four-sided, formed by making a three-sided cut in central portion 18 and bending along the fourth side to extend in the same direction as legs 14 and 16. Additional details of elongated portion 32, in several forms, will be described later.

Body 34 is of conventional construction, being a molded plastic part designed to support the terminals to which the incoming electrical distribution lines are connected, and placed in communication with the slotted contacts for receiving the blades of plugs inserted into the receptacle. Body 34 is attached by suitable means to mounting strap 12, with elongated portion 32 extending through an open portion in the bottom of body 34. Receptacle cover 36, also of molded plastic, is in turn mounted upon body 34 in the usual manner, to provide the assembly of mounting strap 12, body 34 and receptacle cover 36 shown in FIG. 2. Cover 36 is pictured as a standard, 3-wire grounding, duplex receptacle cover with parallel openings for straight blade plugs, although it will be understood that the invention may be practised with many different configurations.

When the outlet box and receptacle assembly have been wired and mounted to a wall stud or other support, the open end of box 10 and receptacle cover 36 are covered by wall plate 38 with the plug-receiving portions of the receptacle cover exposed through openings 40. Plate 38 is secured in position by screw fastener 42 which extends through opening 44. Means must be provided in the underlying structure to anchor the screw and, since it is exposed on the outside of the outlet and is metallic, it must be grounded. As previously mentioned, it has previously been the standard practise to provide another element, in the nature of a hollow rivet or eyelet having internal threads, having one end positioned within a central opening in the receptacle cover and extending to a grounding connection with the mounting strap. In the present invention, however, such element is eliminated, thereby saving the cost of both the element and its assembly with the other components by means which will now be explained.

Figure 4:
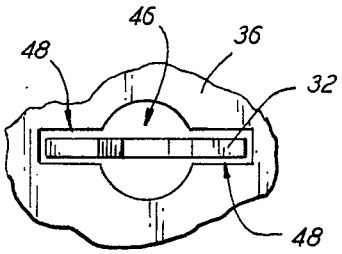
FIG. 4 is an enlarged, fragmentary, front elevational view of a portion of FIG. 2.

Elongated portion 32, which is an integral part of mounting strap 12, provides the ground contact for screw 42 in all embodiments. The anchoring means may be provided by the elongated portion, or by receptacle cover 36, or both. Receptacle cover 36 has an opening including a central, circular portion 46, positioned for alignment with opening 44 in wall plate 38, and slotted side portions 48, extending radially from opposite sides of the circular portion, to accommodate the width of elongated portion 32 which extends into the receptacle cover opening, as seen in FIG. 4.

Figure 5:
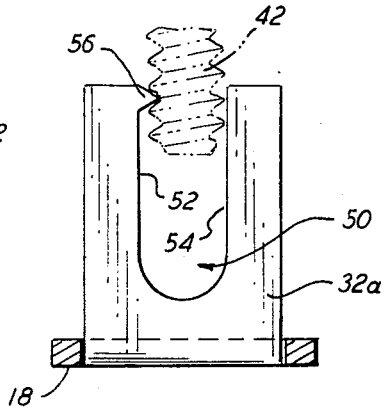
FIGS. 5 and 6 are enlarged elevational views of the central portion of a mounting strap, shown in two configurations, with a screw fastener engaged therewith.
Figure 6:
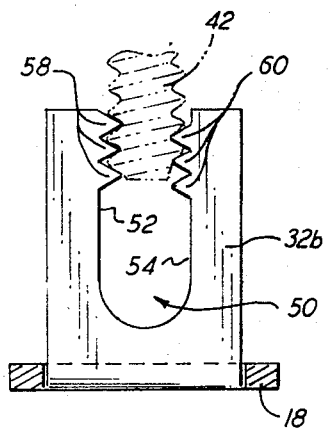

The configurations of the elongated portion as shown in FIGS. 5 and 6 are denoted by reference numerals 32*a* and 32*b*, respectively, each including a central, cut-out area 50 extending from the free end for a portion of the distance to the end integrally connected to central portion 18 of the mounting strap. Spaced, opposing edges 52 and 54 are on opposite sides of cut-out area 50. A single sharp protrusion or tooth 56 extends inwardly from edge 52 of elongated portion 32*a*, and a plurality of teeth 58 and 60 extend inwardly from each of edges 52 and 54, respectively, of portion 32*b*. The spacing of edges 52 and 54, and the size and spacing of the teeth, are so established that the threads of screw fastener 42 are engaged thereby as the screw is rotatably advanced into the opening, whether only one or a plurality of teeth are provided. The cut-out area and teeth may conveniently be provided in the same stamping operation by which the elongated portion is formed.

Figure 2:
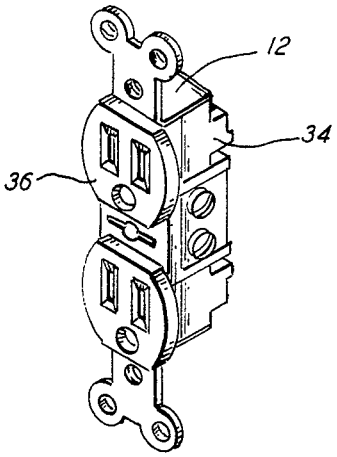
FIG. 2 is a perspective view of certain elements of the receptacle of FIG. 1 in the assembled condition.
Figure 3:
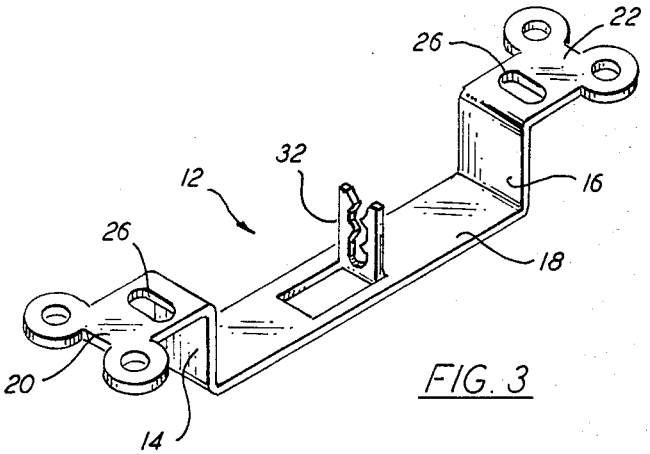
FIG. 3 is a perspective view of the mounting strap of the receptacle of FIGS. 1 and 2.
Figure 7:
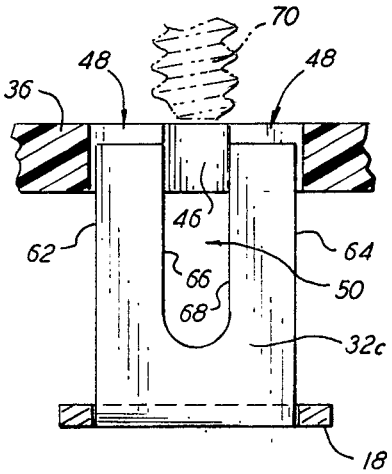
FIGS. 7 and 8 are views of the same portion of mounting straps as those of FIGS. 5 and 6, illustrating additional embodiments of the invention in association with a fragment of the receptacle cover and a tapping bit.

Elongated portion 32*c* of FIG. 7 is so dimensioned that outer edges 62 and 64 thereof fit rather closely within slotted end portions 48 of the opening in receptacle cover 36. Circular portion 46 of the opening, and the spacing of opposing edges 66 and 68 are equal to the tap size for screw fastener 42 to be used therewith. After assembly of the receptacle components as shown in FIG. 2, tap 70 is advanced into the opening, providing internal threads in circular portion 46 and teeth such as those shown in FIG. 6 on opposing edges 66 and 68. This is calculated to provide a firmer anchor for the screw fastener and is thus the preferred mode of practising the invention.

Figure 8:
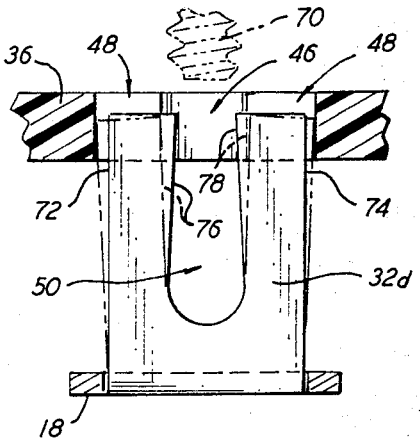

Tap 70 is also used to provide the internal threads and teeth in elongated portion 32*d* of FIG. 8. In this configuration, outside edges 72 and 74, at least in the region of the free end, are spaced by somewhat less than the total width of slotted end portions 48 of the opening in receptacle cover 36. Opposing edges 76 and 78 are spaced by less than the diameter of circular portion 46 of the opening which is again equal to the tap size. Thus, as tap 70 is advanced into the opening, the two legs, i.e. the parts of elongated portion 32*d* on each side of cut-out area 50, are flexed outwardly to the positions indicated by the dot-dash lines due to the springiness or resiliency of the metal (e.g., brass-plated steel). When tap 70 is removed, the tendency of the legs to resume their original position provides a firmer contact with the screw fastener when the wall plate is attached.

Figure 9:
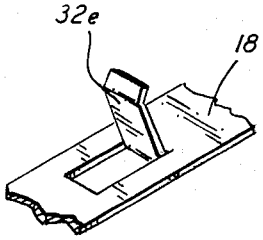
FIG. 9 is a fragmentary, perspective view of a portion of a mounting strap in yet another embodiment.
Figure 10:
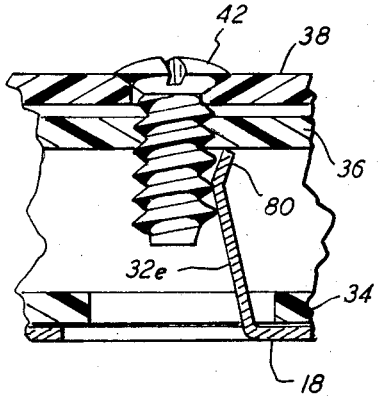
FIG. 10 is an enlarged, fragmentary, side elevational view of a receptacle assembly incorporating the mounting strap of FIG. 9.

Turning now to FIGS. 9 and 10, elongated portion 32*e* is shown in another embodiment wherein cut-out area 50 is omitted. Portion 32*e* again is formed integrally with central portion 18 of mounting strap 12 by a stamping operation, but in this case provides only the grounding contact for the screw which is anchored by self-tapping into an opening of appropriate size in receptacle cover 36. The latter is, of course, constructed of a suitable material to permit such self-tapping. Portion 32*e* extends into the path of the screw, and is bent at the free end 80 so as not to interfere with advance of the screw, preferably being flexed to some degree when the screw is fully inserted and thus providing a good ground contact therewith.

Thus, in all embodiments the invention includes a grounded mounting strap having an integrally formed projection, herein termed an elongated portion, extending toward the receptacle cover to provide a ground path for the metallic screw fastener which secures the wall plate in position. Although wall plates are commonly of plastic, they are sometimes also of metal, in which case the necessary ground path is provided for the wall plate as well as the screw. Internally projecting teeth may be formed by stamping or tapping on spaced, opposing edges of a cut-out area of the elongated member to engage the screw threads and provide the screw anchor. Alternate or cooperative anchor means may be provided by internal threads in the receptacle cover opening through which the screw extends.

What is claimed is:

1. An electrical outlet assembly having electrical terminals and receptacles for receiving a straight blade plug comprising:

(a) a box-like housing having wall members defining an open side;

(b) an electrically grounded mounting strap of flat, electrically conducting metal having opposite end portions respectively secured to an opposing pair of said wall members, and joined by a pair of parallel legs to a central portion in a U-shaped configuration, whereby said central portion lies in a first plane spaced from a second plane in which said end portions lie;

(c) a body portion upon which the electrical terminals and receptacles for the blades are mounted;

(d) a threaded screw fastener;

(e) a receptacle cover having openings for passage of the plug blades and first aperture means lying essentially in said second plane for passage of said screw fastener;

(f) a wall plate positioned in covering relation to said receptacle cover and open side of said housing having open areas through which said receptacle cover openings are exposed and second aperture means in alignment with said first aperture means for loose passage therethrough of said screw fastener;

(g) means retaining said receptacle cover, said body portion and said mounting strap in a predetermined assembled orientation within said housing;

(h) an elongated member formed integrally with said central portion and bent along a fold line to extend from said first plane toward said first aperture means and extending into the path of said screw fastener extending through said second and first aperture means toward said mounting strap central portion;

(i) said elongated member being flexible about said fold line and bent at a medial position to extend to a free end out of said screw fastener path; and (j) said screw fastener being anchored by threaded engagement with said first aperture means to hold said wall plate in position whereby, as said screw fastener is advanced through said second and thence through said first aperture means, it contacts said elongated member at said medial position flexing said elongated member about said fold line to remain in electrical contact therewith, thereby providing a ground path for said screw fastener and any metal parts with which it is in contact.

2. An electrical outlet assembly having electrical terminals and receptacles for receiving a straight blade plug comprising:

(a) a box-like housing having wall members defining an open side;

(b) an electrically grounded mounting strap of flat, electrically conducting metal having opposite end portions respectively secured to an opposing pair of said wall members, and joined by a pair of parallel legs to a central portion in a U-shaped configuration, whereby said central portion lies in a first plane spaced from a second plane in which said end portions lie;

(c) a body portion upon which the electrical terminals and receptacles for the blades are mounted;

(d) a threaded screw fastener;

(e) a receptacle cover having openings for passage of the plug blades and first aperture means lying essentially in said second plane and having a central, circular portion for passage of said screw fastener and a pair of elongated portions extending radially from opposite sides of said circular portion;

(f) a wall plate positioned in covering relation to said receptacle cover and open side of said housing having open areas through which said receptacle cover openings are exposed and second aperture means in alignment with said circular portion of first aperture means for loose passage therethrough of said screw fastener;

(g) means retaining said receptacle cover, said body portion and said mounting strap in a predetermined assembled orientation within said housing;

(h) an elongated member formed integrally with said central portion and bent along a fold line to extend from said first toward said second plane, said elongated member being flat and having a cut-out medial portion extending from the terminal end thereof toward said fold line to form a pair of spaced edges, said elongated member extending longitudinally into said elongated portions of said first aperture means and said edges being spaced by a distance less than the diameter of said circular portion of said first aperture means;

(i) said screw fastener being anchored by threaded engagement with at least the internal periphery of said first aperture means; and (j) said elongated member being outwardly flexible from said spaced edges, whereby insertion of said screw fastener through said second aperture means and thence through said circular portion of said first aperture means places said screw fastener in direct contact with said spaced edges of said elongated member and thereby in electrically grounded contact with said grounded mounting strap.

* * * * *